US005358816A

United States Patent [19]

Wilson et al.

[11] Patent Number: 5,358,816

[45] Date of Patent: Oct. 25, 1994

[54] ZINC SALT OF ORTHO-BENZOIC SULFIMIDE AS NEGATIVE CHARGE-CONTROLLING ADDITIVE FOR TONER AND DEVELOPER COMPOSITIONS

[75] Inventors: John C. Wilson, Rochester; Steven M. Bonser, Fairport; Hans W. Osterhoudt, Spencerport, all of N.Y.

[73] Assignee: Eastman Kodak Company, Rochester, N.Y.

[21] Appl. No.: 114,708

[22] Filed: Aug. 31, 1993

[51] Int. Cl.[5] ..... G03G 9/097

[52] U.S. Cl. ..... 430/106.6; 430/110; 430/124

[58] Field of Search ..... 430/110, 108, 107, 106.6, 430/124

[56] References Cited

U.S. PATENT DOCUMENTS

| | | | |
|---|---|---|---|
| 3,884,825 | 5/1975 | Lindblad et al. | 252/62.1 |
| 3,893,934 | 7/1975 | Braun et al. . | |
| 3,893,935 | 7/1975 | Jadwin et al. . | |
| 4,079,014 | 3/1978 | Burness et al. . | |
| 4,298,672 | 11/1981 | Lu . | |
| 4,338,390 | 7/1982 | Lu . | |
| 4,441,974 | 10/1983 | Lu et al. . | |
| 4,464,452 | 8/1984 | Gruber et al. | 430/110 |
| 4,480,021 | 10/1984 | Lu et al. . | |
| 4,493,883 | 1/1985 | Gruber et al. | 430/110 |
| 4,812,377 | 3/1989 | Wilson et al. | 430/109 |
| 4,812,379 | 3/1989 | Harnisch et al. | 430/110 |
| 4,912,009 | 3/1990 | Amering et al. | 430/137 |
| 5,013,627 | 5/1991 | Harnisch et al. | 430/110 |
| 5,034,297 | 7/1991 | Yoerger | 430/109 |
| 5,061,593 | 10/1991 | Yoerger et al. | 430/108 |
| 5,082,883 | 1/1992 | Alexandrovich et al. . | |
| 5,100,754 | 3/1992 | Yoerger et al. | 430/108 |
| 5,156,937 | 10/1992 | Alexandrovich et al. . | |
| 5,188,919 | 2/1993 | Dewanckele et al. | 430/110 |
| 5,238,768 | 8/1993 | Ong | 430/110 |

FOREIGN PATENT DOCUMENTS

| | | |
|---|---|---|
| 56-006247 | 1/1981 | Japan . |
| 62-163061A | 7/1987 | Japan . |
| 01193747-A | 1/1988 | Japan . |

*Primary Examiner*—Christopher D. RoDee
*Attorney, Agent, or Firm*—Willard G. Montgomery

[57] ABSTRACT

This invention is directed to dry, negatively charged toner compositions and developer compositions, the toner composition being comprised of resin particles prepared from a polyester having a glass transition temperature of 50° to 100° C. and a weight average molecular weight of 20,000 to 100,000, a colorant and, as a charge-controlling additive, the zinc salt of ortho-benzoic sulfimide as represented by the formula:

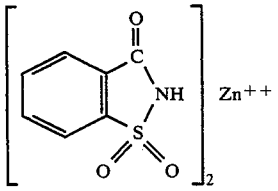

21 Claims, No Drawings

ZINC SALT OF ORTHO-BENZOIC SULFIMIDE AS NEGATIVE CHARGE-CONTROLLING ADDITIVE FOR TONER AND DEVELOPER COMPOSITIONS

FIELD OF THE INVENTION

This invention is generally directed to new toner compositions and developer compositions containing a charge-controlling additive. More specifically, the present invention is directed to developer compositions containing toner particles and, as a charge-controlling additive, the zinc salt of ortho-benzoic sulfimide, which additive imparts a negative charge to the toner resin particles.

Developer compositions containing charge enhancing additives are known in the prior art, particularly, those developers containing charge enhancing additives which impart a positive charge to the toner resin. However, very few developer compositions are known in the art wherein charge enhancing or charge-controlling additives are employed for the purpose of imparting a negative charge to the toner resin. Examples of positively charged toner compositions include those described in U.S. Pat. No. 3,893,935 wherein there is disclosed the use of certain quaternary ammonium compounds as charge-control agents for electrostatic toner compositions. This patent states that certain quaternary ammonium compounds when incorporated into toner materials were found to provide a toner composition which exhibited a relatively high uniform and stable net toner charge when mixed with a suitable carrier particle. A similar teaching is described in U.S. Pat. No. 4,079,014 with the exception that a different charge-control additive is employed, namely, a diazo compound. Other charge enhancing additives are described, for example, in U.S. Pat. No. 4,298,672, wherein there is disclosed developer compositions containing as charge enhancing additives certain alkyl pyridiniumhalides, particularly cetyl pyridinium chloride for the purpose of imparting a positive charge to the toner resin.

Electrophotographic images are typically made in two different ways. In optical copiers, for example, the image on a printed page is reproduced through optical exposure (generally reflection from a mirror) of the page to the photoconductor. Where the page is white or lightly colored, the light reflected from the page discharges the photoconductor. Light is not reflected from the dark areas of the page and consequently the photoconductor retains its original charge in these areas. If the photoconductor was originally charged negatively, the areas to be toned would naturally attract positively charged toners.

A second way of making electrostatographic images is to write the image using an array of light emitting diodes (LED's) or lasers to discharge the photoconductor. Assuming (again) that the photoconductor was originally charged negatively, it becomes much less so in the exposed areas, which are to be toned. Toning is accomplished by using negatively charged toner particles and a voltage on the toning roller that is significantly more negative than the discharged (i.e., exposed) areas but somewhat less negative than the unexposed areas. In this way the toner particles are repelled from the unexposed areas but attracted to the exposed areas.

The negatively charged toner particles of this invention are designed for use in electrostatographic printers in which the photoconductor is originally charged negatively, then partially or completely discharged in the areas to be toned. The negatively charged toner particles of this invention might also be used in optical copiers in which the photoconductor is originally charged positively.

The degree of negative charge of the toners in this invention is imparted by the charge-controlling additive to be described hereinafter. Further, the charge-controlling additive of the present invention possesses other desirable properties. For example, when toner compositions of the present invention containing the zinc salt of ortho-benzoic sulfimide are incorporated into developer compositions containing carrier particles, the developer compositions exhibit low dusting characteristics. Dusting (also referred to as throw-off) is defined as the amount of toner and any other particulate matter that is thrown out of the developer (i.e., that is not adequately held to the surfaces of the carrier particles) during agitation of the developer, e.g., by a typical development apparatus such as a magnetic roll applicator. High levels of dusting can cause undesirable effects such as excessive wear and damage of electrostatographic imaging apparatus, contamination of environmental air with toner powder and other particulate matter, unwanted development of background image areas, and scumming of the surface of photoconductive elements that leads to poorer electrophotographic performance and shorter useful life.

Still further, the toner particles containing the charge-control agent described herein exhibit a uniform, stable electrical charge. That is, all or substantially all, of the individual discrete toner particles exhibit a triboelectric charge of the same sign which is maintained at a specified, optimum level of charge or range of charge necessary for achieving optimum image development and image quality.

SUMMARY OF THE INVENTION

Thus, in accordance with the present invention there is provided an improved dry, electrostatic toner composition and developer compositions thereof, which employ, as a charge-control agent or additive, the zinc salt of ortho-benzoic sulfimide.

The improved toner compositions of the present invention comprise finely-divided fusible resin particles having dispersed or otherwise distributed therein, a colorant and, as a charge-control agent, the zinc salt of ortho-benzoic sulfimide. The resin particles comprise a polyester having a glass transition temperature of 50° to 100° C. and a weight average molecular weight of 20,000 to 100,000.

The colorant, dispersed or otherwise distributed in the resin particles, is a pigment or a dye.

The dry, electrographic developers of this invention comprise a mixture of the inventive toner particles defined above and suitable carrier particles.

Accordingly, in one embodiment of the present invention there is provided a dry, negatively charged electrostatographic toner composition comprised of finely-divided fusible resin particles of a polyester having a glass transition temperature of 50° to 100° C. and a weight average molecular weight of 20,000 to 100,000 having dispersed or otherwise distributed in the resin particles a colorant and, as a charge-controlling additive, the zinc salt of ortho-benzoic sulfimide.

In another embodiment of the present invention, there is provided a new, dry electrostatographic developer composition comprised of a mix of carrier particles and negatively charged toner particles wherein the toner particles are comprised of finely-divided fusible resin particles of a polyester having a glass transition temperature of 50° to 100° C. and a weight average molecular weight of 20,000 to 100,000, having dispersed or otherwise distributed in the resin particles a colorant and, as a charge-controlling additive, the zinc salt of ortho-benzoic sulfimide.

DETAILED DESCRIPTION OF THE INVENTION

As mentioned previously, the charge-control agent or additive employed in the toners and developers of the present invention is the zinc salt of ortho-benzoic sulfimide and can be represented by the formula:

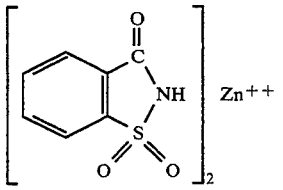

Alternatively, the zinc salt of ortho-benzoic sulfimide as the dihydrate (i.e, $C_{14}H_8N_2O_6S_2Zn \cdot 2H_2O$) can be used as the charge-control agent in the toner and developer compositions of the present invention in lieu of the anhydrous form of the zinc salt of ortho-benzoic sulfimide.

The zinc salt of ortho-benzoic sulfimide as the dihydrate can be prepared by known methods such as, for example, by reacting ortho-benzoic sulfimide with sodium hydroxide in water to form the sodium salt of ortho-benzoic sulfimide and then reacting the sodium salt of ortho-benzoic sulfimide with zinc chloride in the presence of concentrated hydrochloric acid (to clarify the zinc chloride solution) to form the dihydrate form of the zinc salt of ortho-benzoic sulfimide. The zinc salt of ortho-benzoic sulfimide can then be prepared from the dihydrate by heating the dihydrate to a temperature sufficient to remove the water from the dihydrate.

The charge-controlling additive of the present invention can be employed in toner compositions and developer compositions in various amounts, provided they do not adversely affect such materials and result in a toner that is negatively charged in comparison to the carrier particles. Thus, for example, the amount of the zinc salt of ortho-benzoic sulfimide employed ranges from about 0.1 percent by weight to about 10 percent by weight based on the weight of the toner resin particles and, preferably is from about 0.5 percent by weight to about 5 percent by weight of the toner resin particles. The amount of colorant dispersed or otherwise distributed in the resin particles ranges from about 1 to about 20 percent by weight based on the weight of the resin particles.

To be utilized as a charge-control agent in the electrostatic toners of the invention, the zinc salt of ortho-benzoic sulfimide is mixed in any convenient manner (preferably by melt-blending as described, for example, in U.S. Pat. Nos. 4,684,596 and 4,394,430) with an appropriate polymeric toner binder or resin material, a colorant and any other desired toner addenda and the mix is then ground to desired size to form a free-flowing powder of toner particles containing the charge-control agent. Conventional particle classification techniques can be used to achieve a toner particle composition having a desired particle size and size distribution. The toner compositions of the present invention also can be prepared by a number of other methods well known in the art such as spray drying, melt dispersion, dispersion polymerization and suspension polymerization. The resulting electrostatographic toner powder comprises particles of a toner polymer or resin having dispersed or otherwise distributed within each particle the charge-control agent of the present invention, a colorant and any other desired toner addenda. A toner prepared in this manner results in a negatively charged toner in relationship to the carrier materials present in the developer composition and these compositions exhibit the improved properties as mentioned hereinbefore. Other methods of preparation can be utilized providing the objectives of the present invention are achieved.

The average particle size of the powdered toner can be in the range of from about 0.1 to 100 micrometers, a range of from about 1 to 30 micrometers being preferred for many of the office copying machines currently being used. However, larger or smaller particles may be needed for particular methods of development or development conditions. The term particle size" as used herein, or the term "size" as employed herein in reference to the term "particles", means volume weighted diameter as measured by conventional diameter measuring devices, such as a Coulter Multisizer, sold by Coulter, Inc. Mean volume weighted diameter is the sum of the mass of each particle times the diameter of a spherical particle of equal mass and density, divided by the total particle mass.

Resins which are used with the charge-controlling additive of the present invention are polyesters having a glass transition temperature of 50° to 100° C. and a weight average molecular weight of 20,000 to 100,000. The polyesters are prepared from the reaction product of a wide variety of diols and dicarboxylic acids.

Some specific examples of suitable diols are: 1,4-cyclohexanediol; 1,4-cyclohexanedimethanol; 1,4-cyclohexanediethanol; 1,4-bis(2-hydroxyethoxy)-cyclohexane; 1,4-benzenedimethanol; 1,4-benzenediethanol; norbornylene glycol; decahydro-2,6-naphthalenedimethanol; bisphenol A; ethylene glycol; diethylene glycol; triethylene glycol; 1,2-propanediol, 1,3-propanediol; 1,4-butanediol; 2,3-butanediol; 1,5-pentanediol; neopentyl glycol; 1,6-hexanediol; 1,7-heptanediol; 1,8-octanediol; 1,9-nonanediol; 1,10-decanediol; 1,12-dodecanediol; 2,2,4-trimethyl-1,6-hexanediol; and 4-oxa-2,6-heptanediol.

Suitable dicarboxylic acids include: succinic acid; sebacic acid; 2-methyladipic acid; diglycolic acid; thiodiglycolic acid; fumaric acid; adipic acid; glutaric acid; cyclohexane-1,3-dicarboxylic acid; cyclohexane-1,4-dicarboxylic acid; cyclopentane-1,3-dicarboxylic acid; 2,5-norbornanedicarboxylic acid; phthalic acid; isophthalic acid; terephthalic acid; 5-butylisophthalic acid; 2,6-naphthalenedicarboxylic acid; 1,4-naphthalenedicarboxylic acid; 1,5-naphthalenedicarboxylic acid; 4,4'-sulfonyldibenzoic acid; 4,4'-oxydibenzoic acid; binaphthyldicarboxylic acid; and lower alkyl esters of the acids mentioned.

Polyfunctional compounds having three or more carboxyl groups, and three or more hydroxyl groups are desirably employed to create branching in the polyester chain. Triols, tetraols, tricarboxylic acids, and functional equivalents, such as pentaerythritol, 1,3,5-trihydroxypentane, 1,5-dihydroxy-3-ethyl-3-(2-hydroxyethyl)pentane, trimethylolpropane, trimellitic anhydride, pyromellitic dianhydride, and the like are suitable branching agents. Presently preferred polyols are glycerol and trimethylolpropane. Preferably, up to about 15 mole percent, preferably 5 mole percent, of the reactant diol/polyol or diacid/polyacid monomers for producing the polyesters can be comprised of at least one polyol having a functionality greater than two or polyacid having a functionality greater than two.

Variations in the relative amounts of each of the respective monomer reactants are possible for optimizing the physical properties of the polymer.

The polyesters of this invention are conveniently prepared by any of the known polycondensation techniques, e.g., solution polycondensation or catalyzed melt-phase polycondensation; for example, by the transesterification of dimethyl terephthalate, dimethyl glutarate, 1,2-propanediol and glycerol.

The polyesters also can be prepared by two-stage polyesterification procedures, such as those described in U.S. Pat. No. 4,140,644 and U.S. Pat. No. 4,217,400. The latter patent is particularly relevant, because it is directed to the control of branching in polyesterification. In such processes, the reactant glycols and dicarboxylic acids, are heated with a polyfunctional compound, such as a triol or tricarboxylic acid, and an esterification catalyst in an inert atmosphere at temperatures of 190° to 280° C., preferably 200° to 260° C. Subsequently, a vacuum is applied, while the reaction mixture temperature is maintained at 220° to 240° C., to increase the product's molecular weight.

The degree of polyesterification can be monitored by measuring the inherent viscosity of samples periodically taken from the reaction mixture. The reaction conditions used to prepare the high molecular weight polyesters should be selected to achieve an I.V. of 0.10 to 0.80 measured in methylene chloride solution at a concentration of 0.25 grams of polymer per 100 milliliters of solution at 25° C. An I.V. of 0.10 to 0.60 is particularly desirable to insure that the polyester has a weight average molecular weight of 20,000 to 100,000, preferably 55,000 to 65,000, a branched structure and a $T_g$ in the range of about 50° to about 100° C. Amorphous polyesters are particularly well suited for use in the present invention. After reaching the desired inherent viscosity, the polyester is isolated and cooled.

One presently preferred class of polyesters comprises residues derived from the polyesterification of a polymerizable monomer composition comprising:

a dicarboxylic acid-derived component comprising:

about 75 to 100 mole % of dimethyl terephthalate and about 0 to 25 mole % of dimethyl glutarate and a diol/polyol-derived component comprising:

about 90 to 100 mole % of 1,2-propane diol and about 0 to 10 mole % of glycerol.

Many of the aforedescribed polyesters are disclosed in the patent to Alexandrovich et al., U.S. Pat. No. 5,156,937.

Useful binder resins have fusing temperatures in the range of about 65° C. to 200° C. so that the toner particles can readily be fused after development. Preferred are resins which fuse in the range of about 65° C. to 120° C. If toner transfer is made to receiving sheets which can withstand higher temperatures, polymers of higher fusing temperatures can be used. The term "glass transition temperature" or "Tg" as used herein means the temperature at which a polymer changes from a glassy state to a rubbery state. This temperature (Tg) can be measured by differential thermal analysis as disclosed in "Techniques and Methods of Polymer Evaluation", Vol. 1, Marcel Dekker, Inc., N.Y., 1966. The term "inherent viscosity" or "I.V." as defined herein means the logarithmic viscosity number defined in "Properties of Polymers", by D. W. Van Krevelen, Elsevier, North Holland, Inc., 1972. Preferably, toner particles prepared from these polymers have a relatively high caking temperature, for example, higher than about 50° C., so that the toner powders can be stored for relatively long periods of time at fairly high temperatures without having individual particles agglomerate and clump together.

In addition to colorants, various kinds of other well-known addenda (e.g., release agents, such as conventionally used polysiloxanes or waxes, etc.) also can be incorporated into the toners of the invention.

Numerous well known suitable colorant materials selected from dyestuffs or pigments can be employed in the toner materials of the present invention. Such materials serve to color the toner and/or render it more visible. The colorants can, in principle, be selected from virtually any of the compounds mentioned in the Colour Index Volumes 1 and 2, Second Edition.

Included among the vast number of useful colorants are those dyes and/or pigments that are typically employed as blue, green, red, yellow, magenta and cyan colorants used in electrostatographic toners to make color copies. Examples of useful colorants are Hansa Yellow G (C.I. 11680), Nigrosine Spirit soluble (C.I. 50415), Chromogen Black ETOO (C.I. 45170), Solvent Black 3 (C.I. 26150), Hostaperm Pink E-02 (Hoechst-Celanese), Fuchsine N (C.I. 42510),C.I. Basic Blue 9 (C.I. 52015) and Pigment Blue 15:3 (C.I. 74160). Carbon black also provides a useful colorant. As mentioned previously, the amount of colorant added may vary over a wide range, for example, from about 1 to about 20 percent by weight based on the weight of the toner resin particles. Particularly good results are obtained when the amount is from about 1 to about 10 weight percent.

Toners prepared in accordance with this invention are mixed with carrier particles to form developer compositions. The carrier particles can be selected from a variety of materials providing that the toner particles are charged negatively in comparison to the carrier particles. Thus, the carrier particles are selected so as to acquire a charge of positive polarity and include carrier core particles and core particles overcoated with a thin layer of film-forming resin.

The carrier core materials can comprise conductive, non-conductive, magnetic, or non-magnetic materials. See, for example, U.S. Pat. Nos. 3,850,663 and 3,970,571. Especially useful in magnetic brush development systems are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See for example, U.S. Pat. Nos. 4,042,518; 4,478,925; and 4,546,060.

The carrier particles can be overcoated with a thin layer of a film-forming resin for the purpose of establishing the correct triboelectric relationship and charge-level with the toner employed. Examples of suitable resins are described in U.S. Pat. Nos. 3,547,822; 3,632,512; 3,795,618; 3,898,170; 4,545,060; 4,478,925; 4,076,857; and 3,970,571. Especially useful as a thin coating for magnetic carrier particles such as strontium ferrite is a film-forming polymer comprising poly (methyl methacrylate) or a copolymer of p-t-butylstyrene and a $C_1$–$C_4$ alkyl methacrylate such as methyl methacrylate or isobutyl methacrylate.

Typically, when a copolymer of p-t-butylstyrene and methyl methacrylate is used as the coating material, a weight ratio of methyl methacrylate to p-t-butylstyrene of from 75 to 25 or 95 to 5 is employed.

Methods of coating a polymer onto carrier core particles in a continuous or discontinuous configuration of various uniform or non-uniform thicknesses are well known. Some useful coating methods include solution-coating, spray application, plating, tumbling, shaking, fluidized bed coating, and melt-coating. Any such methods can be employed to prepare the coated carrier particles useful for the present invention. See, for example, U.S. Pat. Nos. 4,546,060; 4,478,925; 4,233,387; 4,209,550; and 3,507,686.

The resultant carrier particles can be spherical or irregular in shape, can have smooth or rough surfaces, and can be of any size known to be useful in developers. Conventional carrier particles usually have an average particle diameter in the range of about 1 to about 1200 micrometers, preferably 1–300 micrometers.

A typical developer composition of the invention containing the above-described toner and a carrier vehicle comprises from about 1 to 20 percent, by weight, of particulate toner particles and from about 80 to about 99 percent, by weight, carrier particles.

The toner and developer compositions of the invention are referred to as electrostatographic compositions. This means that they are not limited to use in electrophotographic processes but can develop images in processes not requiring the use of light sensitive materials, e.g., as in dielectric recording. They are especially useful, however, for developing charge patterns on photoconductive surfaces. The photoconductive surfaces can be of any type, e.g., inorganic photoconductors such as selenium drums and paper coated with a zinc oxide composition or organic photoconductors such as disclosed in the patents to Light, U.S. Pat. Nos. 3,615,414 and Berwick et al., 4,175,960. Thus, in another embodiment of the present invention there is provided a method of developing electrostatic latent images which method comprises contacting the electrostatic latent image with the toner composition of the present invention, followed by transferring the resultant image to a suitable substrate and, optionally, permanently affixing the image by, for example, heat.

Although the dry developer compositions of the invention are useful in all methods of dry development, including magnetic brush development, cascade development and powder cloud development, they are especially suitable for use in the magnetic brush method which, as mentioned previously, employs a so-called two-component developer. This is a physical mixture of magnetic carrier particles and of finely divided toner particles.

As mentioned previously, incorporation of the zinc salt of ortho-benzoic sulfimide charge-control agent into a polymeric toner composition of the type described herein improves the charge uniformity of the toner composition, i.e., provides a toner composition in which all, or substantially all, of the individual discrete toner particles exhibit a triboelectric charge of the same sign, maintains a stable, electrical charge at a specified optimum level or range on the toner particles during the process of continuous development and replenishment, and minimizes the amount of "toner throw-off" of a given developer composition.

The following examples provide a further understanding of the invention.

EXAMPLES

Example 1

Preparation of the Zinc Salt of Ortho-Benzoic Sulfimide

A mixture of 18.32g (0.10 mol) of ortho-benzoic sulfimide, 4.00g (0.10 mol) of NaOH and 200 mL of water was stirred overnight. Next, 6.81g (0.05 mol) $ZnCl_2$ dissolved in 100 mL of water plus five drops of concentrated HCl (to clarify) were added to the original solution. The resultant mixture was stirred for 10 minutes, after which a white solid crystallized from the mixture. Stirring was continued for another hour, after which the solid was collected, washed with water and recrystallized from water. The crystals were washed with water and dried. The yield was 11.9 g (51.1%). The melting point was >250° C.

Anal. Calcd. for $C_{14}H_8N_2O_6S_2Zn.2H_2O$: C,36.10; H,2.60; N,6.02; S,13.77; Zn,14.04

Found: C,35.66; H,2.25; N,6.16; S,14.02; Zn,14.1

Example 2

Toners and Developers

An inventive toner composition of the present invention was formulated from 96 parts by weight of a toner binder comprising a polyester which was a condensation polymer made from dimethyl terephthalate, dimethyl glutarate, 1,2-propanediol and glycerol (mole ratio 87.0:13.0:92.5:5.0); 4 parts by weight of a release agent consisting of a low surface adhesion block copolymer composed of azelaoyl chloride and bisphenol-A joined to a block of aminopropyl-terminated poly(-dimethylsiloxane); 2 parts by weight of the dihydrate of the zinc salt of ortho-benzoic sulfimide prepared as described in Example 1 as a charge-control agent and 5 parts by weight of a colorant Hostaperm Pink E-02 (Hoechst-Celanese). The formulation was melt-blended on a two-roll mill for 20 minutes at 130° C., allowed to cool to room temperature and then pulverized on a Wiley-Mill TM (a brand of pulverizer marketed by Arthur H. Thomas Company, Philadelphia, Pa.) to form non-classified inventive toner particles having a volume average particle size in the range of from about 9 to 11 micrometers. The polyester was prepared according to the following procedure:

Polymer Preparation

A mixture of 422.4g (2.175 mol) of dimethyl terephthalate; 52.1g (0.325 mol) of dimethyl glutarate; 252.1g (3.3125 mol) of 1,2-propanediol; 11.5g (0.125 mol) glycerol and a catalytic amount (25 drops) of titanium tetraisopropoxide was heated in a 1L polymer flask equipped with a Vigreaux-Claisen head, nitrogen inlet and sealed side arm according to the following schedule:

2 hrs at 220° C.;

1 hr at 240° C.; and 1 hr at 240° C. with the head removed.

A metal blade stirrer was then introduced and the mixture was stirred at 240° C. for 1.0 hr at 0.60 mm pressure. The polymer which resulted was then cooled and isolated.

IV (DCM)=0.43

$T_g$=64° C.

An inventive developer was prepared by mixing the toner particles prepared as described above (at a weight concentration of 12% toner) with carrier particles comprising strontium ferrite cores thinly coated (approximately 2 percent by weight) with a copolymer of methyl methacrylate and p-t-butylstyrene (weight ratio: 95/5). The volume average particle size of the carrier particles was from about 25 to 35 micrometers. Toner charge was then measured in microcoulombs per gram of toner (μc/g) in a "MECCA" device for the inventive toner formulated as described above. The optimum level of charge for achieving optimum image development and image quality for the inventive toner, formulated as described above, is from −20 to −60 microcoulombs per gram of toner, preferably from −30 to −50 microcoulombs per gram of toner. Prior to measuring the toner charge, the developer was vigorously shaken or "exercised" to cause triboelectric charging by placing a 4 gram sample of the developer (3.52 grams of carrier and 0.48 gram of toner) into a glass vial, capping the vial and shaking the vial on a "wrist-action" shaker operated at about 2 Hertz and an overall amplitude of about 11 cm for 2 minutes. Toner charge level after 2 minutes of exercising was measured by placing a 100 milligram sample of the charged developer in a MECCA apparatus and measuring the charge and mass of transferred toner in the MECCA apparatus. This involves placing the 100 milligram sample of the charged developer in a sample dish situated between electrode plates and subjecting it, simultaneously for 30 seconds, to a 60 Hz magnetic field to cause developer agitation and to an electric field of about 2000 volts/cm between the plates. The toner is released from the carrier and is attracted to and collects on the plate having polarity opposite to the toner charge. The total toner charge is measured by an electrometer connected to the plate, and that value is divided by the weight of the toner on the plate to yield the charge per mass of toner in microcoulombs per gram (μc/g).

The toner charge level (i.e., charge-to-mass ratio) also was taken after exercising the developer for an additional 10 minutes by placing the magnetized developer in a glass bottle on top of a typical device designed to form a developer into an agitating magnetic brush for development of electrostatic images into toner images (in this case, a cylindrical roll with a rotating magnetic core rotating at 2000 revolutions per minute to closely approximate typical actual use of the developer in an electrostatographic development process). The procedure for measuring the toner charge in microcoulombs per gram with the MECCA apparatus was the same as described above. It should be noted that the microcoulomb per gram values reported below after 10 minutes of exercising are in fact microcoulomb per gram values after the 2 minute shake and 10 minutes on the bottle brush, i.e., after a total of 12 minutes of exercising.

After 2 minutes of shaking, the toner had a charge of −46.8 microcoulombs/gram and after 12 minutes of exercising the toner had a charge of −38.2 microcoulombs/gram. This is well within the desired optimum range of charging for the toner composition to achieve optimum image development and image quality. A control developer in which the toner component thereof did not contain the charge-control agent of the present invention was prepared for comparative purposes using the same carrier particles in the same proportions as were used in the inventive developer composition described above. Thus, there was prepared a toner composition formulated from 96 parts by weight of a toner binder comprising a polyester prepared according to the procedure described above, 4 parts by weight of the same release agent described above and 5 parts by weight of the same colorant utilized in the inventive toner composition described above. The formulation was melt-blended on a two-roll mill for 20 minutes at 130° C., cooled to room temperature and pulverized on a Wiley-Mill TM to formnon-inventive toner particles having a volume average particle size in the range of about 9 to 11 micrometers. The charge on the toner after 2 minutes of shaking was −34.2 microcoulombs/gram. However, after 10 of exercising minutes of exercising the toner on the bottle brush, it had dropped to −19.7 microcoulombs/gram. This is below the optimum charging level for the toner composition. As evidenced by these results, the charge-control agent of the present invention was able to establish and maintain the charge to mass ratio at a level for optimum developer performance and hence optimum image development and image quality. In contrast, the tribocharging in the control developer fell below the optimum range for optimum developer performance after 10 minutes of exercising on the bottle brush.

Example 3

This example illustrates that the developers of this invention exhibit a low degree of dusting (toner throw-off). Toner throw-off measurement for the inventive developer composition described in Example 2 was determined by mixing the same inventive toner particles as described in Example 2 above with carrier particles of the same type as described in Example 2 to form a charged developer comprising approximately 12% toner by weight (approximately 3.52 grams of carrier and 480 milligrams of toner); agitating the developer for 2 minutes on a "wrist-action" shaker followed by exercising the developer for 10 minutes on a bottle brush as described in Example 4; mixing more (approximately 240 milligrams) of the same type of fresh inventive toner particles into the developer to form a charged developer comprising about 17% toner by weight (approximately 3.52 grams of carrier and 720 milligrams of toner); shaking the developer on a "wrist-action" shaker for 2 minutes as described above; placing the developer in an open container held in place on top of the bottle brush device described above; placing a funnel, containing a weighed piece of fiberglass filter paper and a vacuum hose connected to its spout, in an inverted position securely over the open container spaced approximately 5 cm from the container; simultaneously for one minute, rotating the magnetic core of the brush at 500 revolutions per minute to form an agitating magnetic developer brush as in a normal development process and applying vacuum (approximately 361 torr) to the funnel to collect on the filter paper any material thrown off of the agitating magnetic developer brush; weighing the filter paper and collected material; and then subtracting the weight of the filter paper alone from this combined weight to determine the degree of dusting in milligrams (mg). Previous experience has shown that under these test conditions, good developer formulations lose at most 10 milligrams of toner (i.e., less than 1.4 weight percent of the toner actually present). The amount of toner throw-off for the inventive developer of Example 2 was only 1.4 milligrams of toner which is a very low amount of throw-off. The amount of throw-off for the control developer described in Example 2 also was determined in the same manner as described above for the inventive developer and found to be 4.6 milligrams of toner.

Thus, the addition of the charge-control agent employed in the present invention improves the charge uniformity of the toner composition, i.e., provides a toner composition in which all, or substantially all, of the individual discrete toner particles exhibit a triboelectric charge of the same sign, maintains a stable, electrical charge on the toner particles at a specified optimum level or range of charge and reduces toner throw-off.

Although the invention has been described in considerable detail with particular reference to certain preferred embodiments thereof, variations and modifications can be effected within the spirit and scope of the invention.

What is claimed is:

1. A dry, negatively charged electrostatographic toner composition comprised of finely-divided resin particles of a polyester having a glass transition temperature of 50° to 100° C. and a weight average molecular weight of 20,000 to 100,000 having dispersed or otherwise distributed in the resin particles a colorant and, as a charge-controlling additive, the zinc salt of ortho-benzoic sulfimide or the dihydrate of the zinc salt of ortho-benzoic sulfimide.

2. A toner composition according to claim 1, wherein the polyester has a glass transition temperature of 50° to 96° C. and is derived from the polyesterification of a polymerizable monomer composition comprising:

a dicarboxylic acid-derived component comprising:
75 to 100 mole percent of dimethyl terephthalate and
0 to 25 mole percent of dimethyl glutarate and
a diol/polyol-derived component comprising:
90 to 100 mole percent of 1,2-propanediol and
0 to 10 mole percent of glycerol.

3. A toner composition according to claim 1, wherein the polyester contains a branching agent.

4. A toner composition according to claim 1, wherein the polyester has a glass transition temperature of about 64° C.

5. A toner composition according to claim 1, wherein the resin particles are spherical particles.

6. A toner composition according to claim 1, wherein the resin particles are irregular, pulverized particles.

7. A toner composition according to claim 1, wherein the resin particles have an average particle size of from about 0.1 to 100 micrometers.

8. A toner composition according to claim 1, wherein the charge-controlling additive is present in an amount of from about 0.1 to about 10 percent by weight based on the weight of the resin particles.

9. A toner composition according to claim 1, wherein the colorant is present in an amount of from about 1 to about 20 percent by weight based on the weight of the resin particles.

10. A toner composition according to claim 1, where the colorant comprises pigment particles selected from magenta, cyan and yellow pigments.

11. A dry, electrostatographic developer composition comprised of a mix of carrier particles and negatively charged toner particles wherein the toner particles are comprised of resin particles of a polyester having a glass transition temperature of 50° to 100° C. and a weight average molecular weight of 20,000 to 100,000 having dispersed or otherwise distributed in the resin particles a colorant and, as a charge-controlling additive the zinc salt of orthobenzoic sulfimide or the dihydrate of the zinc salt of ortho-benzoic sulfimide and wherein each of the carrier particles comprises a core particle having an overcoat 30 of a polymer comprising poly(methyl methacrylate) or a copolymer of p-t-butylstyrene and a $C_1$–$C_4$ alkyl methacrylate.

12. A developer composition according to claim 11, wherein the core particle comprises a metallic material.

13. A developer composition according to claim 12, wherein the metallic material is ferromagnetic.

14. A developer composition according to claim 13, wherein the metallic material comprises a strontium ferrite material.

15. A developer composition according to claim 11, wherein the mix of toner particles and carrier particles comprises from about 80 to 99 percent by weight of finely divided carrier particles and from about 1 to 20 percent by weight of finely divided toner resin particles.

16. A developer composition according to claim 11, wherein the charge on the toner is from −20 to −60 microcoulombs per gram of toner in the developer.

17. A developer composition according to claim 11, wherein the charge-controlling additive is present in an amount of from about 0.1 to about 10 percent by weight based on the weight of the resin particles.

18. A developer composition according to claim 11, wherein the colorant is present in an amount of from about 1 to 20 percent by weight based on the weight of the resin particles.

19. A developer composition according to claim 11, wherein the colorant comprises pigment particles selected from magenta, cyan and yellow pigments.

20. A developer composition according to claim 11, wherein the carrier particles comprise magnetic particles of a core material of strontium ferrite coated with a thin layer of a resin comprising a copolymer of methyl methacrylate and p-t-butylstyrene wherein the weight ratio of methyl methacrylate to p-t-butylstyrene is 95:5 and the toner resin particles comprise a polymeric binder comprising a polyester having a glass transition temperature of 50° to 96° C. and a weight average molecular weight of 20,000 to 100,000 derived from the polyesterification of a polymerizable monomer composition comprising:

a dicarboxylic acid-derived component comprising:
75 to 100 mole percent of dimethyl terephthalate and
0 to 25 percent of dimethyl glutarate and
a diol-polyol-derived component comprising:
90 to 100 mole percent of 1,2-propanediol and
0 to 10 mole percent of glycerol.

21. A method of developing an electrostatic latent image which comprises forming an electrostatic latent image on an insulative surface of an electrostatographic element, contacting the resulting image with a dry, negatively charged electrostatographic toner composition comprised of finely-divided resin particles of a polyester having a glass transition temperature of 50° to 100° C. and a weight average molecular weight of 20,000 to 100,000 having dispersed or otherwise distributed in the resin particles a colorant and, as a charge-controlling additive, the zinc salt of ortho-benzoic sulfimide or the dihydrate of the zinc salt of ortho-benzoic sulfimide to produce a toned image followed by transferring the toned image to a suitable substrate and permanently affixing the image thereto.

* * * * *